US010895253B2

(12) United States Patent
Velschow et al.

(10) Patent No.: US 10,895,253 B2
(45) Date of Patent: Jan. 19, 2021

(54) MICRO DOSAGE PERISTALTIC PUMP FOR MICRO DOSAGE OF FLUID

(71) Applicant: Fluisense ApS, Allerød (DK)

(72) Inventors: Sten Velschow, Vedbæk (DK); Martin Toft Madsen, København Ø (DK); Alistair David Morton, Kastrup (DK); Michael Hansen, Faaborg (DK)

(73) Assignee: FLUISENSE APS, Allerød (DK)

( * ) Notice: Subject to any disclaimer, the term of this patent is extended or adjusted under 35 U.S.C. 154(b) by 91 days.

(21) Appl. No.: 16/072,646

(22) PCT Filed: Jan. 24, 2017

(86) PCT No.: PCT/DK2017/050013
§ 371 (c)(1),
(2) Date: Jul. 25, 2018

(87) PCT Pub. No.: WO2017/129192
PCT Pub. Date: Aug. 3, 2017

(65) Prior Publication Data

US 2018/0372085 A1 Dec. 27, 2018

(30) Foreign Application Priority Data

Jan. 25, 2016 (DK) ..... 2016 70038

(51) Int. Cl.
*F04B 43/12* (2006.01)

(52) U.S. Cl.
CPC ..... *F04B 43/123* (2013.01); *F04B 43/1238* (2013.01); *F04B 43/1253* (2013.01)

(58) Field of Classification Search
CPC ..... F04B 43/123; F04B 43/1243; F04B 43/1238; A61M 5/14228
See application file for complete search history.

(56) References Cited

U.S. PATENT DOCUMENTS 2,679,807 A * 6/1954 Bruckmann ..... F04B 43/1253 418/45
3,105,447 A 10/1963 Ruppert
4,559,040 A * 12/1985 Horres ..... F04B 43/123 417/474

(Continued)

FOREIGN PATENT DOCUMENTS

CN 101876311 A 11/2010
DE 2636901 A * 2/1978

(Continued)

*Primary Examiner* — Nathan C Zollinger
(74) *Attorney, Agent, or Firm* — Dinsmore & Shohl LLP

(57) ABSTRACT

The invention regards a micro dosage peristaltic pump (3) for micro dosage of a fluid, comprising: a housing (4) with an inner surface (5) comprising at least one circular section (6), a flexible tube (8) placed upon the at least one circular section of the surface, a flexible layer (9) placed between the surface and the flexible tube, at least one compression element (10), driving means for moving the at least one compression element in an eccentric circular motion having a circular circumference (14), whereby the at least one compression element is peristaltically engaged at the circumference with the tube placed upon the circular section of the surface.

18 Claims, 17 Drawing Sheets

(56) References Cited

U.S. PATENT DOCUMENTS

| | | | | |
|---|---|---|---|---|
| 4,856,972 | A * | 8/1989 | Van Benschoten | F04B 43/12 417/477.11 |
| 5,326,236 | A | 7/1994 | Kramer et al. | |
| 8,056,333 | B1 * | 11/2011 | Bennett | F04B 17/05 60/487 |
| 2005/0129545 | A1 | 6/2005 | Prosek | |
| 2011/0028341 | A1 * | 2/2011 | Wang | G01N 15/147 506/9 |
| 2012/0148415 | A1 | 6/2012 | Brueckner | |
| 2014/0053941 | A1 * | 2/2014 | Belcak | F04B 43/0072 138/125 |

FOREIGN PATENT DOCUMENTS

| | | | | |
|---|---|---|---|---|
| DE | 3322843 | A1 | 1/1985 | |
| EP | 1880669 | A1 | 1/2008 | |
| EP | 2674177 | A1 | 12/2013 | |
| GB | 1405838 | A * | 9/1975 | F04B 43/1253 |
| GB | 1405838 | A | 9/1975 | |
| WO | 9415098 | A1 | 7/1994 | |
| WO | 2014045047 | A1 | 3/2014 | |
| WO | 2014064414 | A1 | 5/2014 | |

* cited by examiner

A

B

C

MICRO DOSAGE PERISTALTIC PUMP FOR MICRO DOSAGE OF FLUID

This application is the U.S. national stage of PCT/DK2017/05013 filed Jan. 24, 2017, which claims priority of Denmark Patent Application PA 201670038 filed Jan. 25, 2016 of which is hereby incorporated by reference in its entirety.

FIELD OF INVENTION

The invention relates to a micro dosage peristaltic pump for micro dosage of a fluid.

BACKGROUND OF THE INVENTION

Peristaltic pumps are widely used for medical purposes, from large pumps used to pump large volumes of blood, to miniature peristaltic pumps to pump small dosages of blood or medicament.

For medical purposes it is essential to avoid contamination of a pumped fluid. It is therefore essential that the fluid is not exposed to the surroundings, and that the pump can be properly cleaned and sterilised, both before use and in storage, as well as after use and in-between uses, and/or that the parts in contact with the fluid can be easily replaced or disposed of after use.

Peristaltic pumps are particularly suitable for medical purposes. In a peristaltic pump, the fluid is conducted through the pump in a pliable tube, and no other parts of the pump are in contact with the fluid. Furthermore, the pliable tube is typically a silicone tube, which is easily sterilised by radiation sterilisation, such as gamma radiation.

The pliable tube of a peristaltic pump in operational configuration will be compressed at one or more sites, this is also denoted the peristaltic coupling. However, peristaltic pumps that are stored and sterilised in a configuration where the tube is compressed, suffer from two main disadvantages:

Firstly, there is a risk of permanent deformation of the pliable tube during storage, and thus short shelf life of the pump. A deformed tube, such as a partly occluded tube, will affect the precision and reliability of the pump, and may compromise the safety by increased risk of air bubbles and clogging of the fluid.

Secondly, there is a risk of fusing opposing surfaces of the compressed pliable tube together during radiation sterilisation. The issue is more pronounced for micro dosage pumps where the diameter of the tube is smaller.

To mitigate the risks, the peristaltic pump may be stored and sterilised in a non-operational configuration. For example, the tube may be sterilised and stored separately, and then assembled into the pump shortly before use.

Correspondingly, the pump may be partly disassembled during storage, and upon assembling the tube becomes compressed. U.S. Pat. No. 4,559,040 describes a peristaltic pump comprising an eccentric rotor, and a detachable part of a stator, which has a configuration where the tube is not compressed, when the detachable part is removed.

However, for a peristaltic pump to be simple and easy to use, it is advantageous that the parts of the pump can be stored and sterilised in an assembled configuration.

EP 2 674 177 discloses a peristaltic pump, where the transition from mechanically distressed tube configuration to stressed tube, occur while the parts of the pump are assembled. The compression/decompression of the tube occur by the engagement and lateral displacement of a multiple of gears.

There is a need for peristaltic pumps for micro dosage with improved precision and reliability, such as reduced risk of flow irregularities and particularly backflow. It is furthermore desirable to obtain pumps comprising a minimum number of parts, and thus require a minimum of power for operation and maintenance, and where the pump is simple to use, maintain and sterilise, and where the parts in contact with the fluids are easily replaced or disposed.

SUMMARY OF THE INVENTION

A first aspect of the invention relates to a micro dosage peristaltic pump 3 for micro dosage of a fluid, comprising: a housing 4 with an inner surface 5 comprising at least one circular section 6, a flexible tube 8 placed upon the at least one circular section of the surface, a flexible layer 9 placed between the surface and the flexible tube, at least one compression element 10, driving means for moving the at least one compression element in an eccentric circular motion having a circular circumference 14, whereby the at least one compression element is peristaltically engaged at the circumference with the tube placed upon the circular section of the surface.

A second aspect relates to a kit of parts comprising the pump according to the first aspect of the invention, and one or more micro dosage peristaltic pump(s), wherein the parts are optionally assembled to a handheld device.

A third aspect relates to the use of the pump or kit of parts according to the first and second aspect of the invention, for pumping fluids such as blood, anticoagulants, and medicaments.

DESCRIPTION OF THE DRAWINGS

The invention will in the following be described in greater detail with reference to the accompanying drawings:

FIG. 7 shows a schematic embodiment of the pump in parking position, FIG. 8 shows an embodiment where the gears are rotated 45 degrees, FIG. 9 where the gears are rotated 90 degrees, FIG. 10 where the gears are rotated 180 degrees, and FIG. 11 where the gears are rotated 270 degrees.

DETAILED DESCRIPTION OF THE INVENTION

Figure 1:
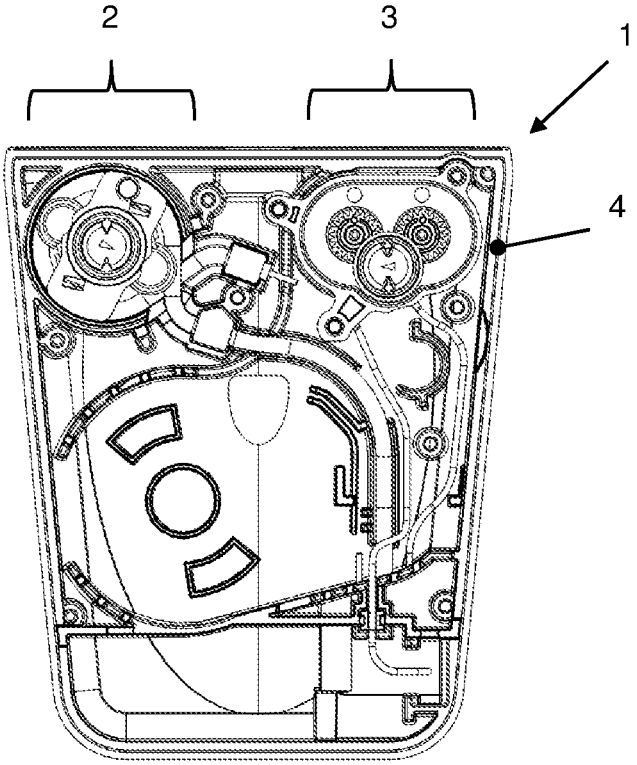
FIG. 1 shows a schematic top view of a handheld medical device comprising an embodiment of the pump according to the present invention.

The present invention provides a micro dosage peristaltic pump with a shape and size allowing it to be built into a portable or wearable or handheld medical device 1 as illustrated in FIG. 1. The wearable device may comprise multiple micro dosage peristaltic pumps, where the different pumps may be applied for pumping different fluids. For example, the wearable device 1 shown in FIG. 1, comprises two micro dosage pumps, where the first micro dosage pump 2 may be used for pumping blood, and the second micro dosage pump 3 may be of a type according to the present invention, and may be used for pumping a medicament, such as an anticoagulant.

The housing may further comprise external holding elements for attaching the micro dosage peristaltic pump to a desired site.

By the term fluid as used herein is meant any substance that is capable of flow, such as liquids, gasses, plasmas, and plastic solids. Examples of fluids for peristaltic pumps for medical purposes may include blood and medicaments, such as anticoagulants.

Figure 2:
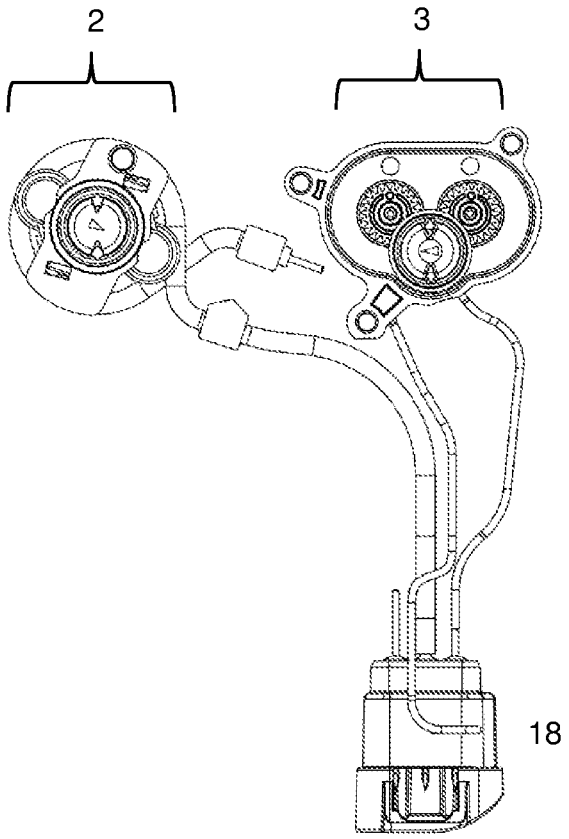
FIG. 2 shows a schematic top view of the device in FIG. 1 without the housing.
Figure 3:
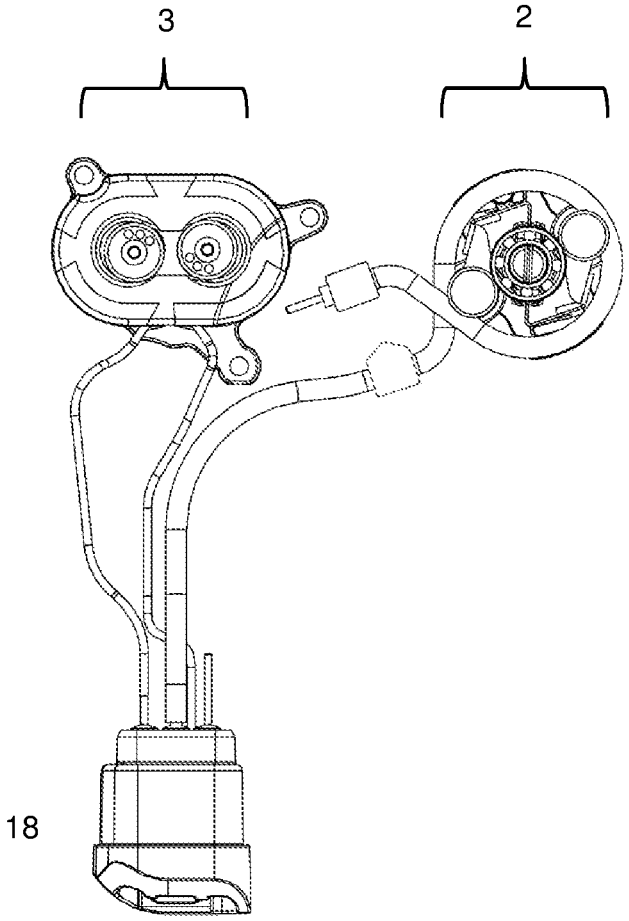
FIG. 3 shows a schematic bottom view of the device in FIG. 1 without the housing.

The pumps are placed inside a housing 4 that is part of the wearable device. FIG. 2 shows a top view of the pumps without the housing, and FIG. 3 shows a bottom view of the pumps without the housing.

Operational Principle

Figure 4:
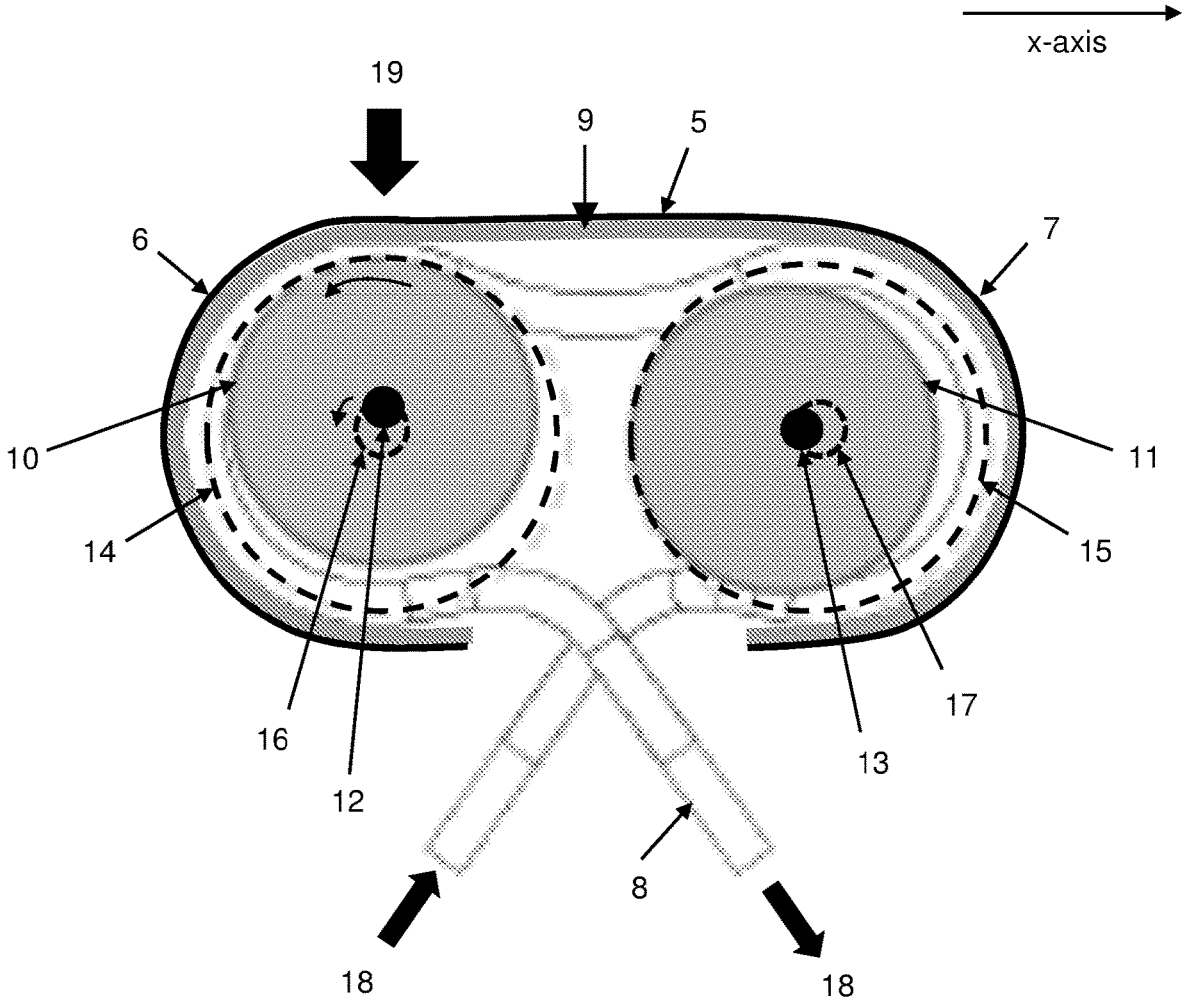
FIG. 4 shows a schematic embodiment of a pump comprising two rollers, and where the flexible tube has one occlusion point.

A sketch of a micro dosage peristaltic pump 3 according to the present invention is shown in FIG. 4. FIG. 4 exemplifies an embodiment comprising two compression elements 10 and 11, and where the compression elements are rollers, which is a preferred embodiment. However, embodiments of the present invention comprising only one compression element or roller, or more than two compression elements or rollers, are also possible.

The operational principle is based on a fluid being contained within a flexible tube 8, and where a section of the tube is placed upon an inner surface 5. A flexible layer 9 is placed in between the flexible tube and the surface. The inner surface may be placed within the housing 4 as illustrated in FIG. 1.

A part of the flexible tube may be pinched closed, or occluded, by a compression element 10. When a compression element presses against the tube, the tube is pressed against the flexible layer, which is then elastically compressed against the inner surface. This will result in the part of the tube under compression being pinched closed, either fully or partly, as indicated by 19 and the big arrow in FIG. 4.

The compression element is driven in an eccentric circular motion, called the compression element circular motion. The circumference of the eccentric circular motion is indicated by dashed line 14 and arrow in FIG. 4.

The eccentric circular motion of the compression element may be obtained by driving means (not shown in FIG. 4), where the driving means comprise a shaft 12, attached centrally to the compression element, and where the shaft is rotated in a circular motion, indicated by dashed line in FIG. 4, and called the shaft circular motion 16. Thus, when the shaft is moved in the shaft circular motion 16, the compression element is moved in the eccentric circular motion with the circumference 14.

The shape of the inner surface comprises a circular section 6, which is concentric with the circumference 14, but with a larger radius.

The radius of the circular section 6 of the inner surface is configured such that the compression element occludes the flexible tube at the point, where the compression element is along the circumference 14. The point where the flexible tube is occluded is denoted the occlusion point 19, and is also indicated by the bigger arrow in FIG. 4. As the compression element moves along the circumference 14, the occlusion point will move along.

The continuous movement of the occlusion point is also denoted peristaltic engagement, or peristaltic coupling. The peristaltic coupling in the present invention is obtained by the engagement between the compression element, flexible tube, flexible layer and the inner surface.

The peristaltic coupling facilitates fluid being pumped to and from a distal opening 18, as shown by arrows in FIG. 4. The propulsion of a fluid in the tube is also known as peristalsis, and peristaltic motion.

Occlusion points can only exist for the part of the circumference 14, where the tube is placed upon the circular section 6 of the inner surface. Thus, when the compression element moves along the parts of the circumference, where the tube is not placed upon the circular section, the tube is not occluded, and thus, the tube will be mechanically distressed.

The position of the compression element along the circumference may be defined by the shaft rotation angle. The shaft rotation angle is the angle, by which the shaft is rotated relative to the center of the shaft circular motion, and counter-clockwise to an x-axis, as shown in FIGS. 4-5.

Thus, in FIG. 4, the left roller has a shaft rotation angle of 90 degrees, and the right roller has a shaft rotation angle of 180 degrees. In FIG. 5 the left roller has a shaft rotation angle of 0 degrees, and the right roller has a shaft rotation angle of 180 degrees.

Figure 5:
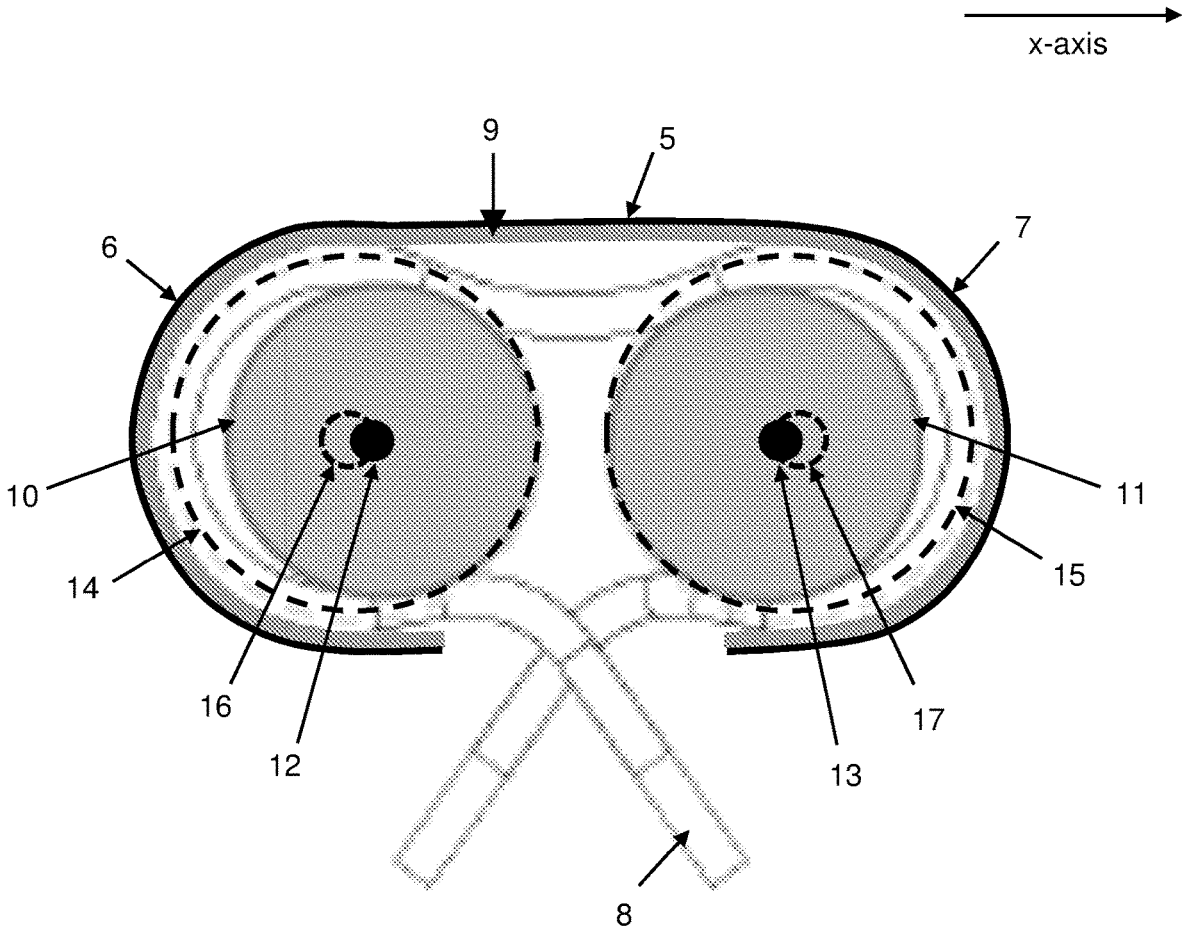
FIG. 5 shows a schematic embodiment of a pump comprising two rollers, and where the flexible tube is mechanically distressed.

In FIGS. 4-5, the tube will be occluded by the left roller, when the left roller has a shaft rotation angle between ca. 90-270 degrees, such as 90 degrees as in FIG. 4. At rotation angles below 90, and above 270 degrees, the tube will not be occluded by the left roller, such as 0 degrees as in FIG. 5.

Correspondingly for the right roller, the tube will be occluded by the right roller, when the right roller has a shaft rotation angle below 90 degrees, and above 270 degrees, and the tube will not be occluded by the right roller when the shaft rotation angle is between 90-270 degrees.

Thus, depending on the positions of each of the rollers, the tube may be mechanically distressed as shown in FIG. 5, or have one occlusion point as shown in FIG. 4, or have two occlusion points, when both rollers are occluding the tube.

Inner Surface

The inner surface comprises at least one circular section. The circular section may be a full circle, or only part of a full circle. The inner surface may further comprise multiple circular sections.

In FIGS. 4-5, the inner surface comprises two circular sections, 6 and 7, and where the circular sections are semicircles. A semicircle may also be defined as a circular section with a central angle of 180 degrees. By the term "central angle" is meant the angle whose apex is the center of the circle defined by the circular section, and whose legs are the radii intersecting the circle.

In FIGS. 4-5, the inner surface further comprises linear sections, such that the inner surface obtains a stadium shape.

The circular sections may have larger central angles than 180 degrees. When the circular sections become larger, the shape of the inner surface will approach the shape of the "figure eight".

Embodiments where the circular section comprises a full circle are also possible, for a pump comprising only one roller.

The inner surface may further comprise an opening for the tube to enter and exit the inner surface. At the opening the tube may lie double, i.e. one tube section above the other, as exemplified in FIGS. 4-5.

In an embodiment of the invention, the at least one circular section 6 is concentric with the circular circumference 14. In another embodiment, the at least one circular section 6 has a central angle of equal to or above 180 degrees, more preferably above 200 degrees, and most preferably above 220 degrees. In another embodiment, the at least one circular section 6 is selected from the group consisting of: a circle, and a semicircle. In another embodiment, the surface has the shape selected from the group consisting of: a circle shape, a stadium shape, a figure-eight-shape, and any combinations thereof.

Tubing

By the term flexible tube 6 as used herein is meant any hollow tube that is capable of being pinched closed by compression, and return to its original shape when not being pinched anymore. A hollow tube is further characterised by having a lumen surrounded by the tube wall.

For medical purposes the material of the tube should be capable of being cleaned, flushed and/or sterilized, and the tube material should not be reactive with fluids such as blood and medicaments. Examples of flexible tubes for peristaltic pumps for medical purposes include tubes of any type of silicone.

In general the tubing in peristaltic pumps must be compressed to less than the sum of the thickness of the two walls being compressed, to ensure complete closure of the lumen. Complete closure is essential for precise dosage of the pumped fluid upon each rotation of the compression element. Thus, the tube may be compressed to more than the sum of the two walls, such as at most 80 to 85% of the sum of the two walls.

The thicker the walls of the tubing the more energy is expended in occluding the lumen. Thus, if the flexible tube comprises a thin walled tube, the pump requires a minimum of energy to compress the tubing, and to ensure complete closure of the lumen for precise dosage of the fluid within.

Furthermore, if the inner diameter of the tube wall is small, less energy is expended in occluding the lumen. Flexible tubes with small inner diameters further enables precise and accurate dosage of even small micro liter doses, or micro liter flows.

Thus, a micro dosage pump as described in the current invention, can used in a wearable system with limited battery power supply. The pump can further accurately deliver an exact flow or volume of fluid, by using tubing with small inner diameter.

Flexible Layer

Controlled compression and occlusion of the tubing is essential for the precision of the pump. If the degree of compression on the tube is not consistent, the degree of occlusion of the tube can vary, which may result in irregularities in the flow, as well as risk of back flow. To fully control the compression and occlusion, irregularities in the tube properties and irregularities of the inner surface must be taken into account as well.

The compression may be controlled by the incorporation of tolerance absorbing means. The tolerance absorbing means reduce the variations in the compression force on the tube that are due to variations in the tube properties, such as diameter, thickness of tube walls or flexibility, and variations in the roughness of the inner surface engaging with the tube.

The ability to compensate for structural irregularities is particularly necessary in small pumps, where even small irregularities are relatively large, and where the tube walls are thin and/or the inner lumen of the tube is small.

Additionally, the introduction of tolerance absorbing means allows for larger tolerance variations in the production, which means that the production of the various parts, such as tube, and roller, may be less costly and less complex.

Conventional tolerance absorbing means include feathers and flexible materials connected to the compression element. Thus, additional components are needed for the compression element to be flexibly attached within the device.

In contrast to this, the tolerance absorbing means of the invention is provided by the flexible layer placed between the inner surface and the tube. Thus, the invention provides tolerance absorbing means that are not directly connected to the compression element, and which is thus the pump is more simple to manufacture.

Furthermore, the flexible layer makes it possible to make the diameter or length of the tube path smaller, since the compression element(s) can be made simpler and smaller.

Thus, it is possible to make the pumped fluid volume per pump revolution smaller, which means that the pump can pump smaller volumes, and thus provide more precise and accurate pumping.

The peristaltic pump of the invention facilitates the pumping or dosage of micro dosages with improved precision and reliability In an embodiment of the invention, the pump is configured to provide a flow rate between 1-20 μL/min, more preferably between 2-10 μL/min, and most preferably between 3-6 μL/min.

The flexible layer provides tolerance absorbance, and ensures that the compression force on the tube is essentially constant, when the tube is pinched to occlusion. This is obtained when the flexible tube is pressed by the roller, the tube is compressed against the flexible surface, which provides a flexible counter pressure to occlude the tube.

The flexible surface may also be referred to as a feathering surface, or a cushioning surface. An example of a flexible surface is a surface of a silicone-based material, however, the material may be any flexible rubberlike material.

The flexible rubber-like material may be attached, e.g. by gluing or moulding, to a hard surface, thereby forming a buffer layer, which the tube can be compressed against. The tube may be either physically contacting the buffer layer, or moulded into the buffer layer.

The tolerance absorbing means of the invention, i.e. the flexible surface, ensure that any variations or roughness in the structural components are compensated for in a simple but highly effective manner. Thus, by the present invention it is possible to precisely pump, and dose or dispense even very small volumes of a fluid, and surprisingly high precision of micro dosage peristaltic pumps can be obtained.

For controlled compression and occlusion of the tube, and for optimal tolerance absorbance, it is essential that the flexible layer and flexible tube are fixed with respect to each other. The tube and layer may be fixed to each other by being attached by glue or by being moulded together. This will further make the assembly of the pump less complex.

In an embodiment of the invention, the flexible tube is attached to the flexible layer, such as moulded together.

Compression Element(s)

The compression element(s) 10 and 11 may be in the form of roller(s), which have a cylindric shape. The cylindric surface of the roller can compress a tube evenly against a surface. In FIGS. 4-5, the longitudinal axis of the rollers, corresponding to the height of the cylindric roller, is parallel to the shaft rotation axis. The compression element(s) may further be configured to rotate around their respective longitudinal axis.

Other examples of compression elements include "shoes", "wipers", "lobes", and "caps".

The compression elements may be attached to the driving means by a shaft that is centrally attached to the compression element. By centrally attached is meant that the compression element extends radially and concentrically from the shaft. Thus, for a roller compression element, the shaft is attached centrally to the roller diameter, and parallel to the longitudinal axis of the roller.

In the embodiments exemplified in FIGS. 4-5, the pump comprises two compression elements that are rollers, a first roller 10, and a second roller 11. The rollers are driven in a first and second eccentric circular motion with respectively a first circumference 14, and a second circumference 15. The eccentric circular motions are obtained by the rotation of the first shaft 12 and second shaft 13, which are attached centrally to the respective compression elements, and where the shaft is rotated in a first 16 and second 17 shaft circular motion. The rollers may further be configured to rotate around their respective longitudinal axis by being rotatably mounted on the shafts.

The pump with two rollers enables very high precision in dosage and flow rate, with a minimum of compression elements. A minimum of compression elements are desired as it influences on the number of deformations of the tubing, and thus the wear of the tubing and pump. Higher wear of the tubing increases the energy consumption of the pump, and wear of the tubing may include risk of spallation of the inner tubing wall, causing tubing materials to enter the blood stream of the patient.

To facilitate the movement between the compression element and the flexible tube, the compression elements may be configured to be rotatable mounted. In an embodiment of the invention, the compression element(s) are configured to rotate around their respective longitudinal axis. In another embodiment, the driving means comprise a shaft 12 attached centrally to the at least one compression element, and wherein the shaft is rotated in a shaft circular motion 16, whereby the eccentric circular motion of the at least one compression element is obtained.

In another embodiment, the pump comprises a first 10 and a second roller 11, and where the rollers are moved in a first and second eccentric circular motion having respectively a first 14 and second 15 circumference.

In a further embodiment, the driving means comprise a first shaft 12 and second shaft 13 attached centrally to respectively the first and second roller, and where the shafts are rotated in respectively a first shaft circular motion 16, and a second shaft circular motion 17.

Configurations with Two Rollers

Several configurations exist for a pump comprising two rollers. When the rollers are facing each other as in FIG. 5, the tube is not pinched or occluded along any point within the pump. Thus, in this configuration, the tube will be mechanically distressed.

In the mechanically distressed configuration, the tube is fully open for a flow. The configuration is also referred to as the starting or parking position, the parking mode, or the mechanically disstressed mode.

The position of the compression element in the parking position is also called the dead point.

For the pump shown in FIG. 5, the tube is mechanically disstressed when the first roller (left roller) has a shaft rotation angle of 0 degrees, and the second roller (right roller) has a shaft rotation angle of 180 degrees.

A micro dosage peristaltic pump, which has a parking position while the pump being in fully assembled and operational state, is especially advantageous for medical purposes. The sterilisation of a peristaltic pump and the flexible tube is preferably done by radiation sterilisation when the pump is in a configuration where the tube is not compressed. This avoids a risk of fusing, and partially/fully occluding, the tube during irradiation sterilisation. Thus, a micro dosage pump with a parking position can be sterilised at any time before storage or use, without further assembling needed after the sterilisation.

The pump is in operation mode, when at least one of the rollers is rotated out of the dead point.

Each roller will pass the dead point upon a rotation around the circumference; however a pump comprising two rollers may be configured such that at any point during operation, at least one of the rollers is not in a dead point.

A micro dosage pump, which has an operational mode without a parking position during pumping is especially advantageous for applications where back flow is undesired and/or detrimental, such as for medical purposes where there is a pressure difference between the pump and the target, such as a vein, or where there is a pressure differential caused by an elevation difference between the inlet (fluid reservoir) and outlet (catheter tip).

In an embodiment of the invention, the pump is configured to have a parking position wherein the flexible tube is not compressed by the rollers, and an operation mode, wherein the flexible tube is compressed by at least one of the rollers at any time during operation.

Figure 6:
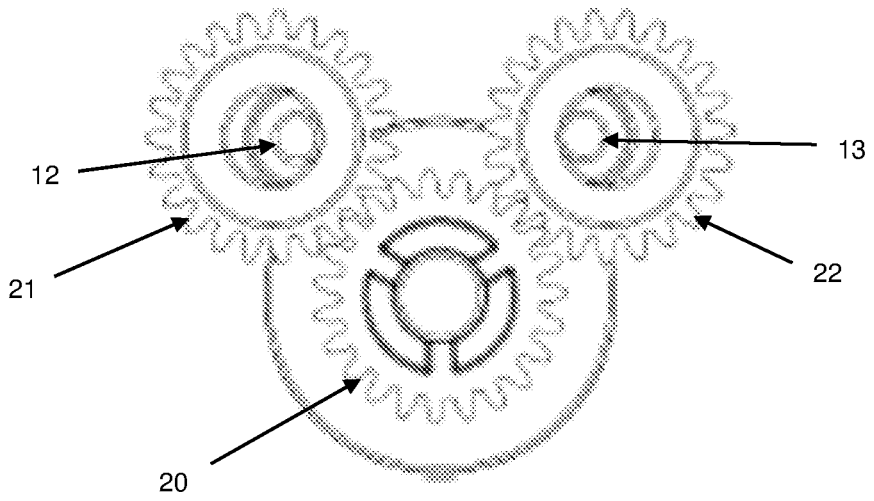
FIG. 6 shows a schematic of driving means for the first and second shaft, comprising a central gear, driving a first gear attached to the first shaft, and a second gear attached to the second shaft.

In operation, the rollers may be working in unison, or synchronisation. This may be obtained by driving means comprising gears. FIG. 6 shows a schematic of driving means for the first shaft 12 and second shaft 13, comprising a central gear 20, driving a first gear 21 attached to the first shaft, and a second gear 22 attached to the second shaft. The shafts are attached eccentrically to the gears, whereby a circular motion of the shafts is obtained when the central gear is rotated.

In an embodiment of the invention, the movement of the first roller is synchronised with the movement of the second roller.

In another embodiment, the pump comprises a central gear driving a first and a second gear, and wherein the first and second shafts are attached eccentrically to the first and second gear respectively.

The transfer from a parking position to a working mode, where the rotations of the shafts are synchronised, may be obtained when both shafts are driven from the same drive means as exemplified in FIG. 6, when one of the shafts are connected to a coupling 24 with a free run. Thus, as the main gear is turned, one shaft will rotate immediately, while the shaft with the free run coupling will remain stationary for the designated number of degrees. The shaft without a coupling with a free run, may optionally be connected to a coupling with no free run 23.

FIGS. 7-11 illustrates the transfer from a parking position to a working mode with synchronised shafts, where the first shaft (left) is connected to a coupling 23 with no free run, and the second shaft (right) is connected to a coupling with a 180 degrees free run 24. Figures A show the rotation of the shafts and the couplings, Figures B the flexible tube and rollers, and Figures C show the gears in a top view.

Figure 7:
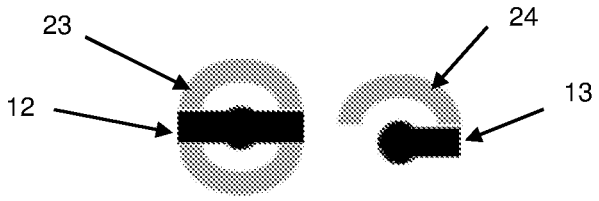
FIGS. 7-11 show a cartoon of the transfer from a parking position to a working mode with synchronised shafts, where the first shaft (left) is connected to a coupling 23 with no free run, and the second shaft (right) is connected to a coupling with a 180 degrees free run 24. Figures A show the rotation of the shafts and the couplings, Figures B the flexible tube and rollers, and Figures C show the gears in a top view.
Figure 7:
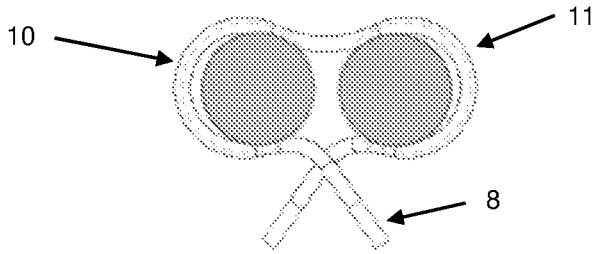
Figure 7:
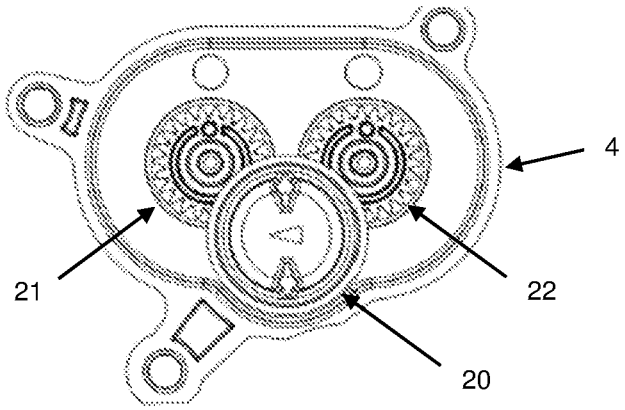

The pump is in parking position in FIG. 7. The rollers are facing each other, and the shafts have not started rotating.

Figure 8:
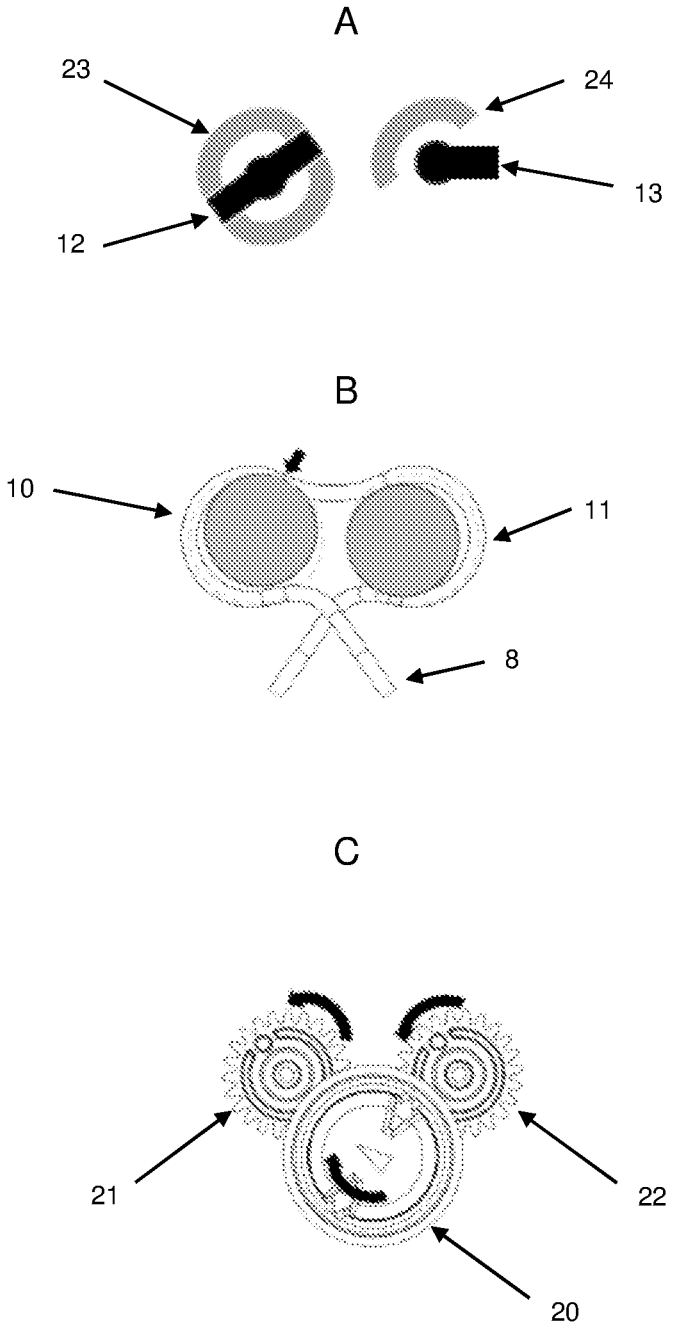

In FIG. 8, the central gear is rotated 45 degrees clockwise as illustrated by the arrow in FIG. 8C, whereby the first and second gears synchronically are rotated 45 degrees counter-clockwise, also indicated by arrows in FIG. 8C. This results in the left shaft being rotated as illustrated in FIG. 8A, and compressing the tube as indicated by the arrow in FIG. 8B. Due to the coupling with a free run, the right shaft is not rotated, and the right roller is thus not compressing the tube.

Figure 9:
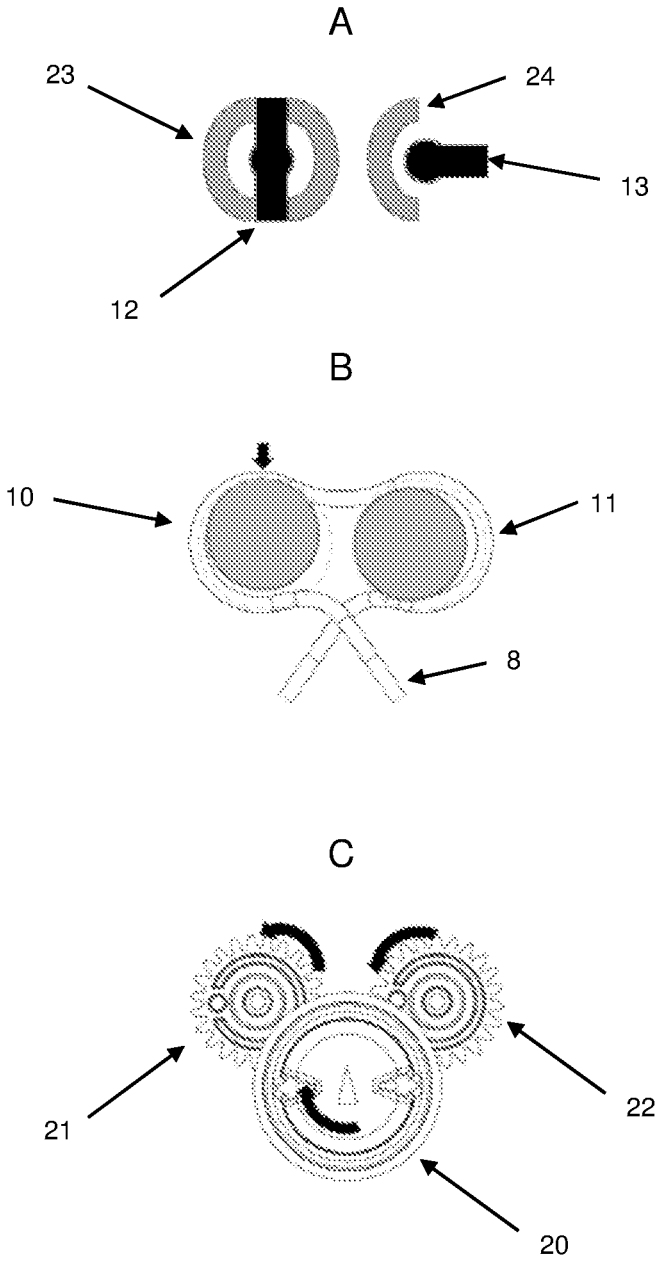

In FIG. 9, the central gear is rotated such that the first and second gears synchronically are rotated 90 degrees counter-clockwise, indicated by arrows in FIG. 9C. This results in the left shaft being rotated as illustrated in FIG. 8A, and compressing the tube as indicated by the arrow in FIG. 9B. Due to the coupling with a free run, the right shaft is not rotated, and the right roller is thus not compressing the tube.

Figure 10:
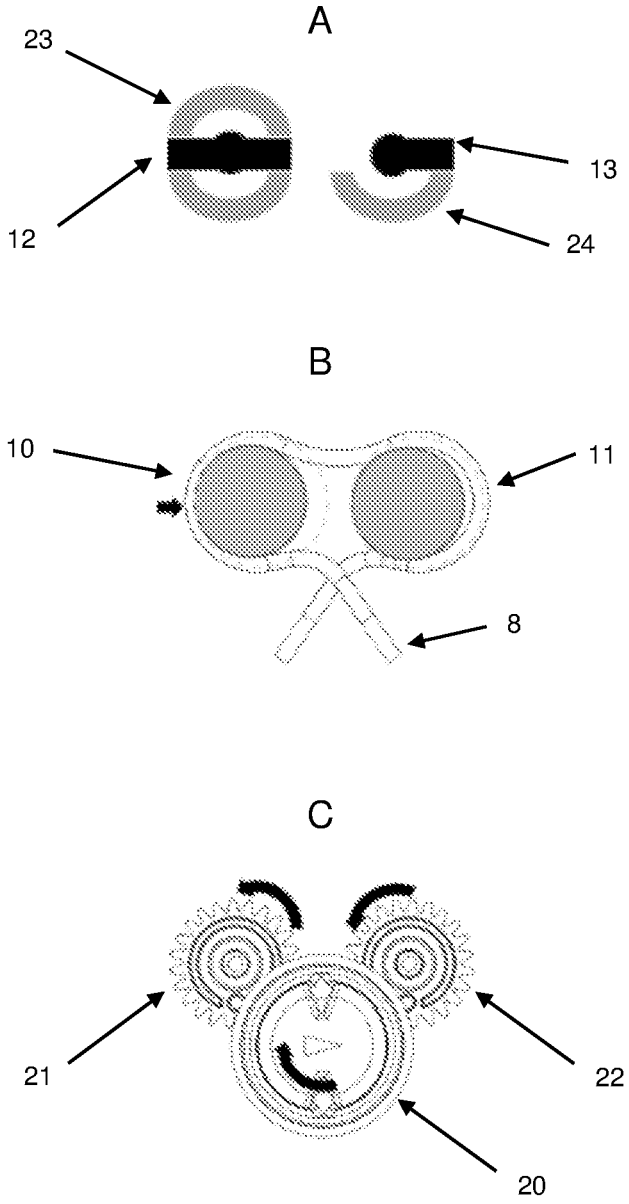

In FIG. 10, the central gear is rotated such that the first and second gears synchronically are rotated 180 degrees counter-clockwise, indicated by arrows in FIG. 10C. This results in the left shaft being rotated as illustrated in FIG. 10A, and compressing the tube as indicated by the arrow in FIG. 10B. Due to the coupling with a free run of 180 degrees, the coupling and right shaft become engaged at this point.

Figure 11:
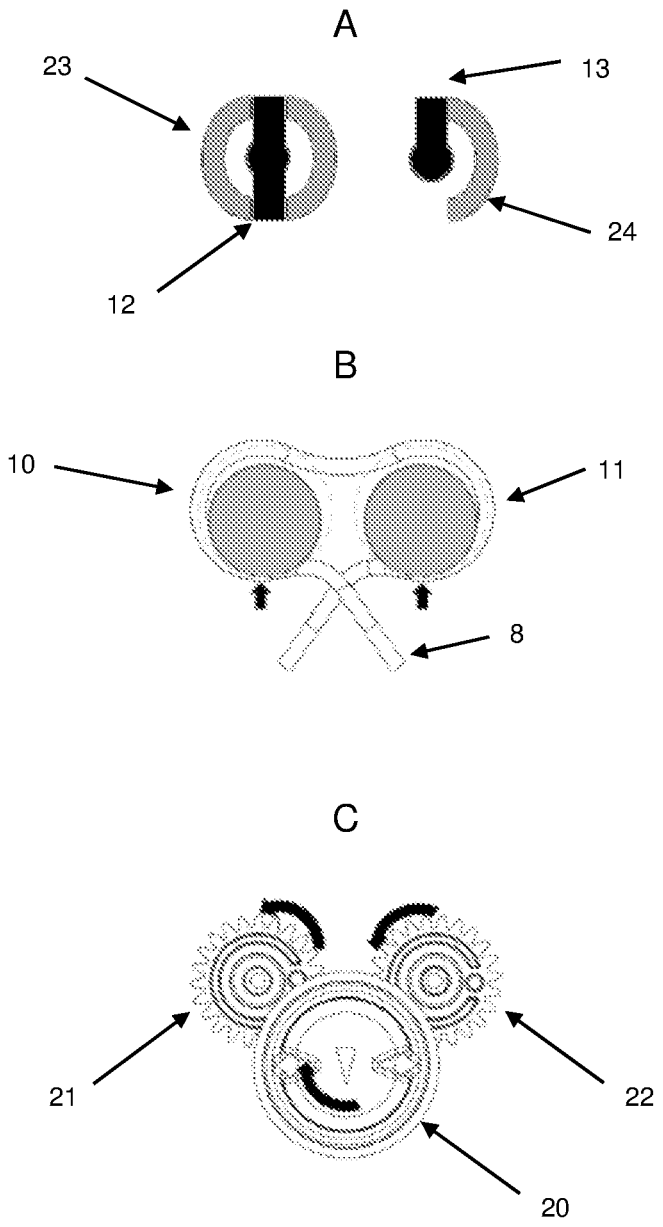

In FIG. 11, the central gear is rotated such that the first and second gears synchronically are rotated 270 degrees counter-clockwise, indicated by arrows in FIG. 11C. Since the coupling and right shaft have engaged, both left and right shafts are now rotated in unison, and at 270 degrees the two rollers will compress the tube at two points as indicated by arrows in FIG. 11B.

In an embodiment of the invention, the gears are engaged to the shafts through a coupling with optionally a free run. In a further embodiment, the second roller is engaged to the second shaft with a free run that is equal to or above 180 degrees, such as 180, 185, or 190 degrees.

Alternatively, transfer from a parking position to a working mode, where the rotations of the shafts are synchronised may be obtained by separate driving means, such as separate motors, for the two shafts.

Figure 12:
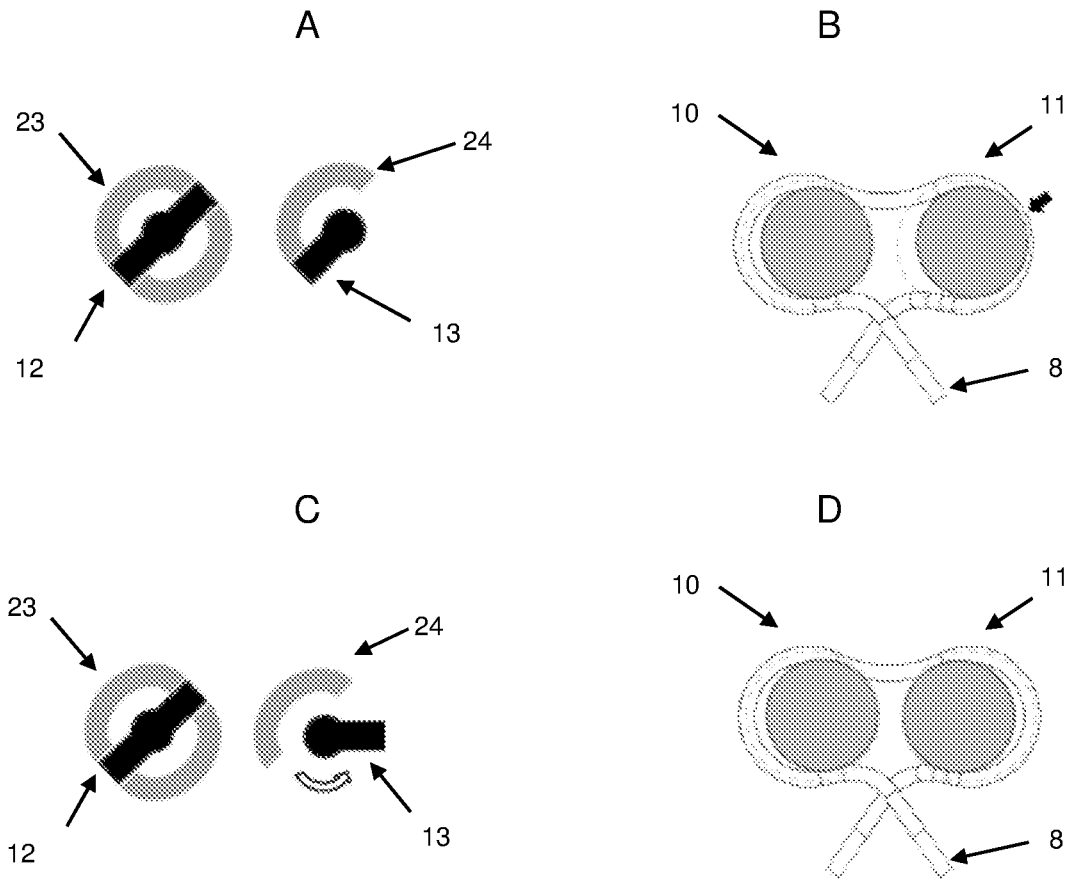
FIG. 12 shows a schematic embodiment where the gears are rotated 360 degrees plus 45 degrees, and where there is a risk of the shaft disengaging from the coupling.

For a shaft connected to a coupling with a 180 degrees free run, there is a risk of the shaft disengaging from the coupling. This can occur if the shafts starts rotating faster, e.g. due to friction and the pressure distribution on the tube, and thus resulting in the compression element moving into the dead point. The situation is illustrated in FIG. 12. In FIG. 12, the shafts are rotated such that the right shaft has engaged with the coupling with 180 degrees free run. The rotation may be 360 degrees plus 45 degrees as exemplified in FIGS. 12A-B, and where the tube is only compressed by the right roller as indicated by the arrow in FIG. 12B.

The force on the right roller stemming from it engaging or pressing on the tube in FIG. 12B, results in the shaft disengaging from the coupling and rotating into the dead-point as illustrated in FIG. 12C. Thus, in this case in operation mode, there is a risk of a parking position to occur, which can cause detrimental backflow.

To minimise the risk of backflow, the rotation of the shafts may be slightly asynchronised in terms of the position in the rotation. The asynchronisation may be obtained by the shaft engaged with the coupling with a 180 degrees free run being slightly behind the left roller in the rotation cycle, as shown in FIG. 13A. The shaft may be 5-10 degrees behind in the position of rotation.

Thus, as the rollers are rotating (FIGS. 13B-C), and the right roller passes the point, where the shaft may be disengaged from the coupling, the left roller will occlude the tube at a point, as shown in FIG. 13D. Thus, the tube will always be pinched at least at one place at any time during operation.

In an embodiment of the invention, the movement of the first roller is at least 1 degree asynchronic with the movement of the second roller, such as 3, 5, 10, 15, and 20 degrees asynchronic.

Figure 13:
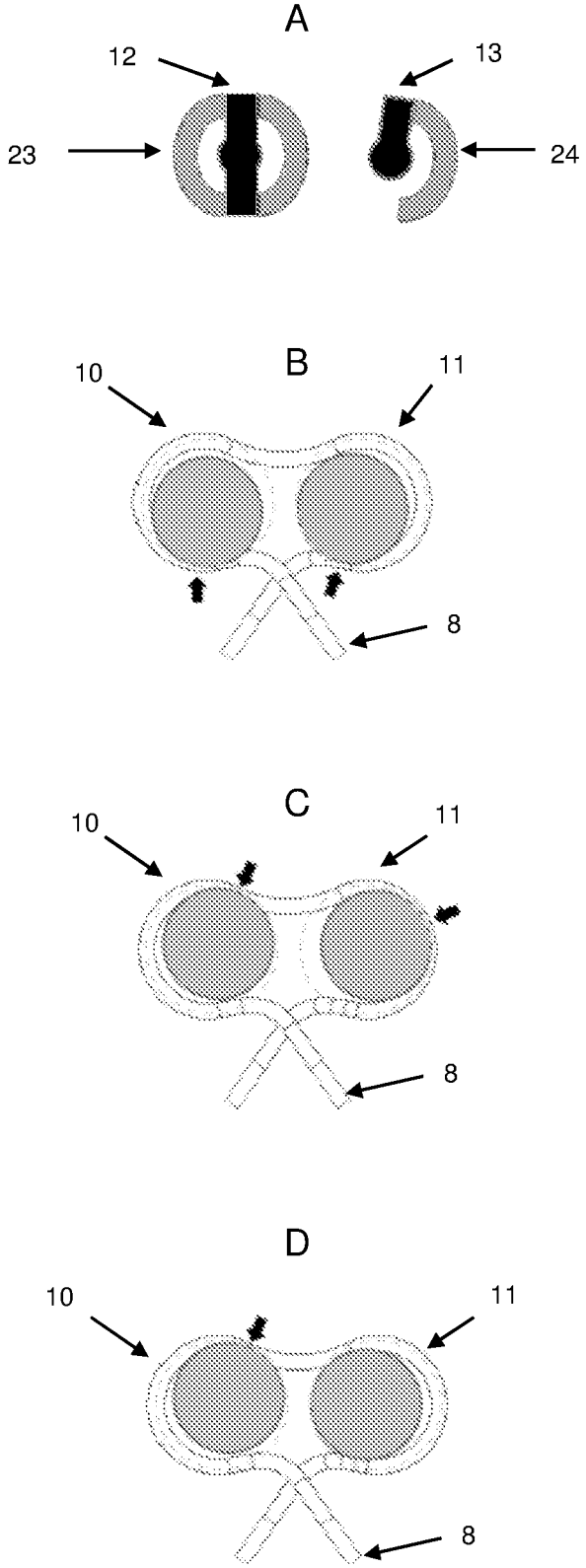
FIG. 13 shows a schematic embodiment, where the rotations of the shafts are slightly asynchronised in terms of the position in the rotation.
Figure 14:
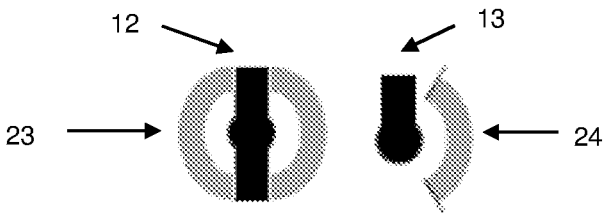
FIG. 14 shows a schematic embodiment using a coupling with more than 180 degrees free run.

Alternatively, the risk of backflow may be minimised by using a coupling with more than 180 degrees free run, as illustrated in FIG. 14. The same effect as shown in FIG. 13 is thereby obtained, where the tube will always be pinched in at least one place at any time during operation.

The asynchronisation of the shafts may be obtained during the assembly of the pump.

After operation of the pump, it may be needed to store, or flush or sterilise the pump. Thus, it is necessary to go from the operation mode, where the tube is pinched in at least one place, to the parking mode, where the tube is not pinched.

Figure 15:
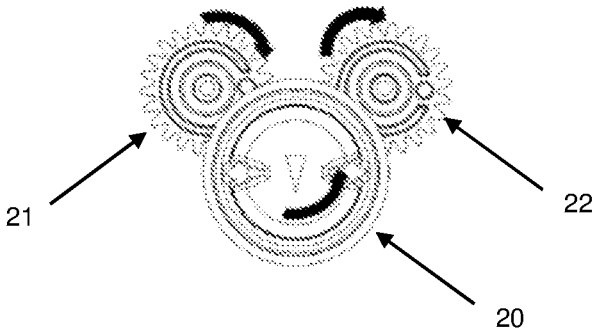
FIG. 15 shows a schematic embodiment of the reverse rotation, or rotating the pump backward.

The transfer from operation mode to parking mode may be obtained by reversing the rotation, or rotating the pump backward, as illustrated in FIG. 15. In FIG. 15 the rotation direction of the central gear is counter-clockwise as opposed to the operation mode in FIGS. 7-11.

Figure 16:
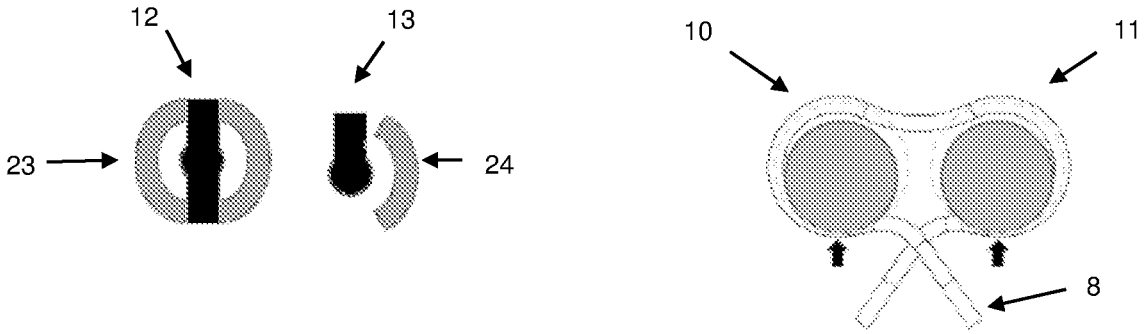
FIG. 16 shows a schematic embodiment of a starting position for reverse rotation.
Figure 17:
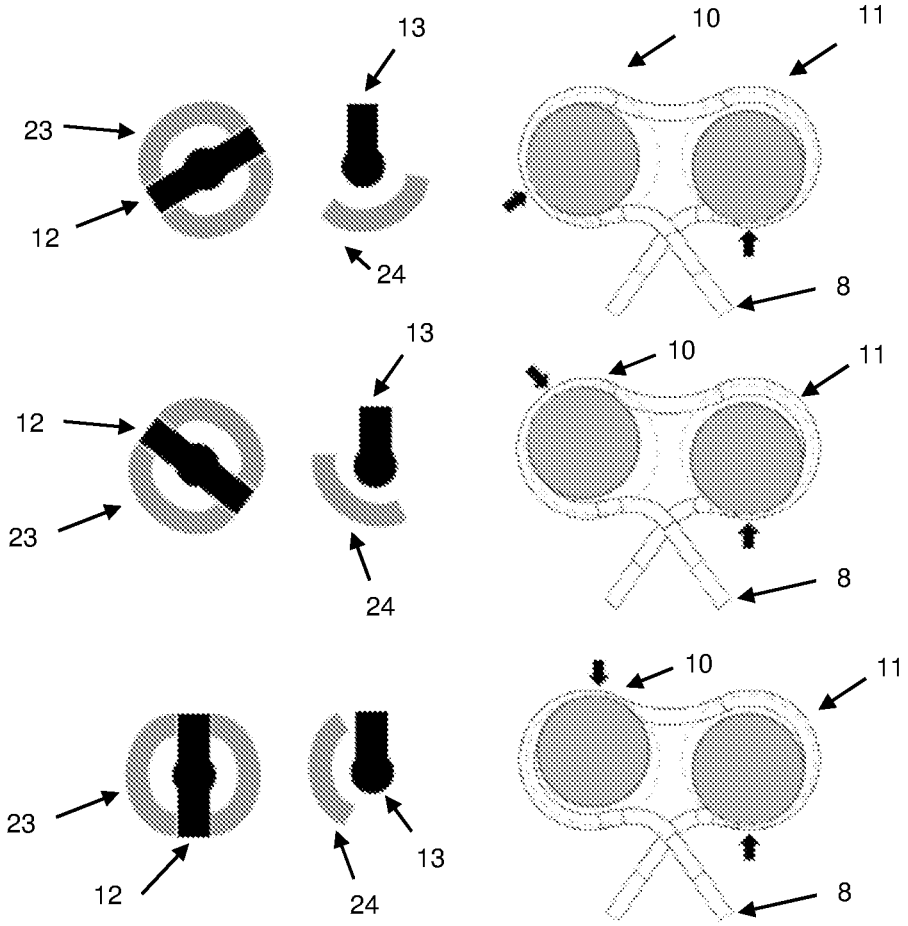
FIG. 17 shows a schematic embodiment of steps in the backward rotation until 180 degrees backward rotation.
Figure 18:
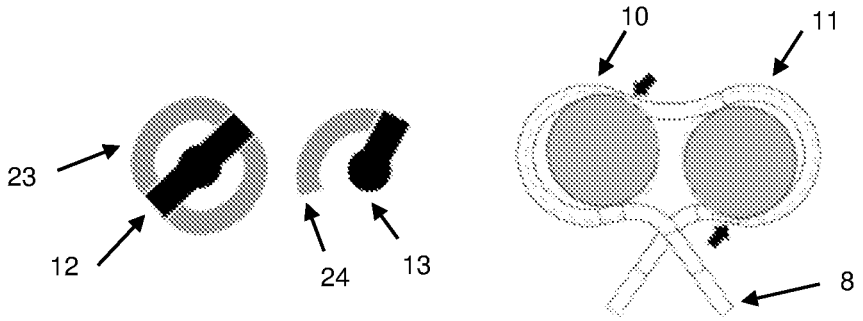
FIG. 18 shows a schematic embodiment of 180 degrees backward rotation where the coupling with free run engages with shaft.
Figure 19:
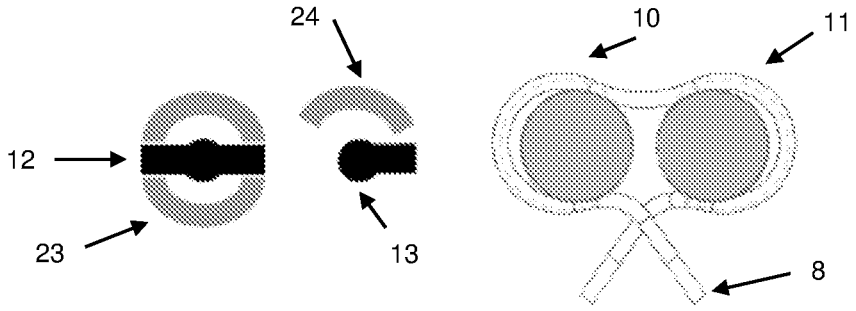
FIG. 19 shows a schematic embodiment of the parking position obtained after backward rotation.

As an example, the rotation is reversed from the position shown in FIG. 16, where both rollers are pinching the tube. Steps in the backward rotation before the coupling with free run engages with the shaft are shown in FIG. 17. In FIG. 18 180 degrees backward rotation is obtained, and at this point the coupling with free run engages with shaft and the parking position can be obtained as shown in FIG. 19.

Thus, a coupling with a free run also facilitates that counter rotating for half a revolution where the free run shaft is disengaged, will disengage both rollers from the tubing. It is therefore simple at any time after operation, to obtain the parking mode position, where the tubing is not compressed, and where the device can be stored and sterilised safely.

Figure 20:
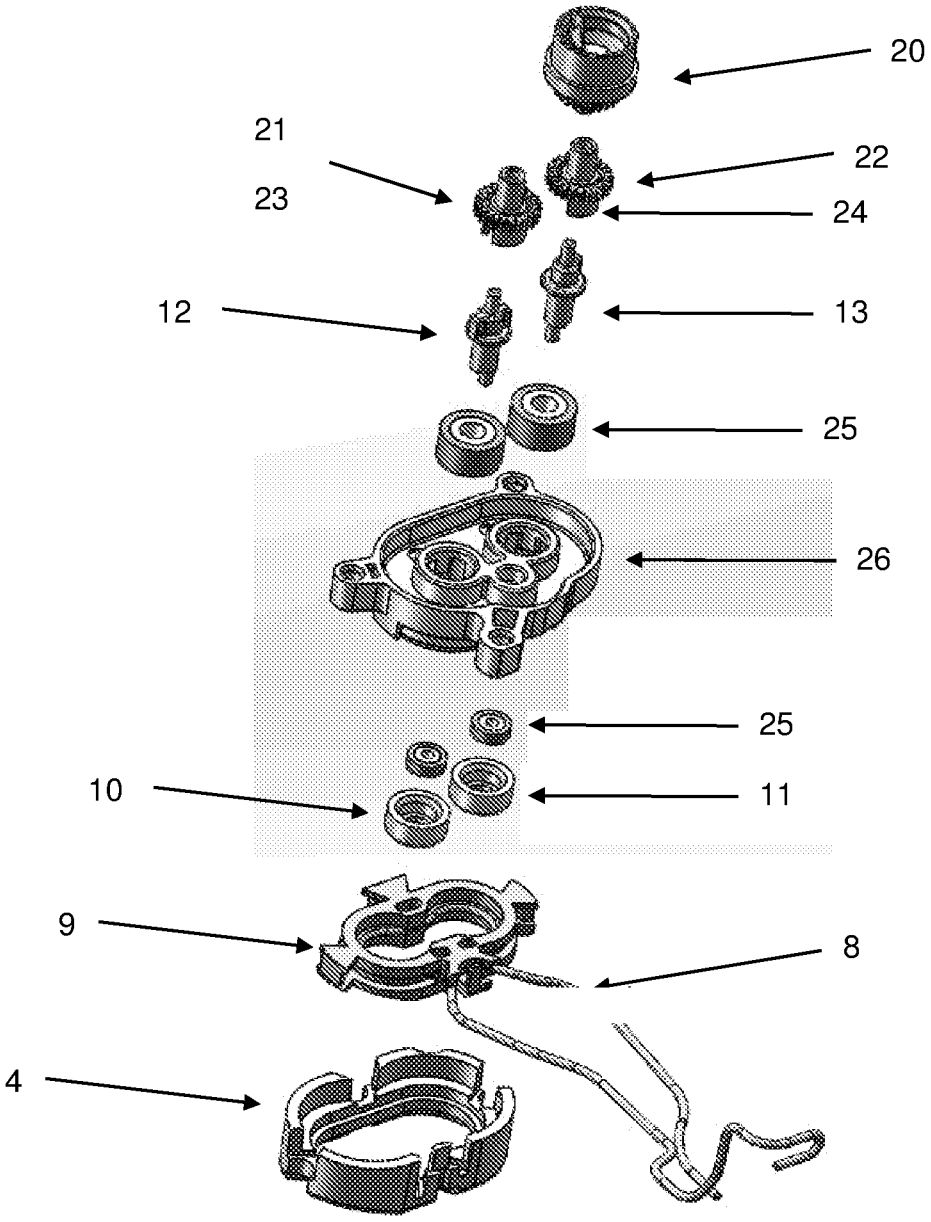
FIG. 20 shows a schematic embodiment of an pump with two rollers in exploded view.

An exploded view of a pump comprising two rollers is shown in FIG. 20. The flexible tube is attached to the flexible layer by being moulded together. The pump may comprise bearings 25, for the rotating parts such as for the shafts and rollers, as well additional housing 26.

REFERENCE NUMBERS

1—wearable device
2—first micro dosage pump
3—second micro dosage pump

4—housing
5—inner surface
6—first circular section
7—second circular section
8—flexible tube
9—flexible layer
10—first roller
11—second roller
12—first shaft
13—second shaft
14—circumference of first eccentric circular motion
15—circumference of second eccentric circular motion
16—first shaft rotation
17—second shaft rotation
18—distal opening
19—occlusion point
20—central gear
21—first gear
22—second gear
23—coupling with no free run
24—coupling with free run
25—bearings
26—second housing

The invention claimed is:

1. A micro dosage peristaltic pump for micro dosage of a fluid, comprising:

a housing with an inner surface comprising at least one circular section;

a tolerance absorbing flexible layer placed on the inner surface;

a flexible tube placed upon the at least one circular section of the inner surface such that the tolerance absorbing flexible layer is disposed between the flexible tube and the inner surface;

at least one compression element comprising a first roller and a second roller, and where the rollers are moved in a first and second eccentric circular motion having respectively a first and second circumference; and a driving element operable to move the respective first and second rollers in the first and second eccentric circular motion having the respective first and second circular circumference, wherein the driving element comprises a first and second shaft attached centrally to respectively the first and second roller, and where the shafts are rotated in respectively a first shaft circular motion, and a second shaft circular motion, the second roller being engaged to the second shaft with a free run that is equal to or above 180 degrees;

whereby the at least one compression element is peristaltically engaged at the circular circumference with the tube placed upon the circular section of the inner surface.

2. The pump according to claim 1, wherein the at least one circular section is concentric with one of the first and second circumference.

3. The pump according to claim 1, wherein the at least one circular section has a central angle of equal to or above 180 degrees.

4. The pump according to claim 1, wherein the at least one circular section is selected from the group consisting of: a circle, and a semicircle.

5. The pump according to claim 1, wherein the inner surface has a shape selected from the group consisting of: a circle shape, a stadium shape, a figure-eight-shape, and any combinations thereof.

6. The pump according to claim 1, wherein the flexible tube is attached to the flexible layer.

7. The pump according to claim 1, wherein the first and second rollers are configured to rotate around their respective longitudinal axis.

8. The pump according to claim 1, configured to have a parking position wherein the flexible tube is not compressed by the rollers, and an operation mode, wherein the flexible tube is compressed by at least one of the rollers at any time during operation.

9. The pump according to claim 1, wherein the movement of the first roller is synchronised with the movement of the second roller.

10. The pump according to claim 1, wherein the movement of the first roller is at least 1 degree asynchronic with the movement of the second roller.

11. The pump according to claim 1, further comprising a central gear driving a first and a second gear, and wherein the first and second shaft are attached eccentrically to the first and second gear respectively.

12. The pump according to claim 11, wherein the gears are engaged to the shafts through a coupling.

13. The pump according to claim 1, configured to provide a flow rate between 1-20 μL/min.

14. The pump according to claim 1, wherein the tolerance absorbing flexible layer is separate from the flexible tube.

15. The pump according to claim 1, wherein the tolerance absorbing flexible layer is a flat layer.

16. A kit of parts comprising the pump according to claim 1, and one or more micro dosage peristaltic pump(s).

17. A method of pumping fluids, comprising the steps of:

providing a pump according to claim 1; and pumping a fluid by operating the driving element.

18. A micro dosage peristaltic pump for micro dosage of a fluid, comprising:

a housing with an inner surface comprising at least one circular section;

a flexible tube placed upon the at least one circular section of the inner surface;

a flexible layer placed between the inner surface and the flexible tube;

at least one compression element comprising a first roller and a second roller, the rollers being moved in a first and second eccentric circular motion having a first and second circumference, respectively; and a driving element comprising a first and second shaft attached centrally to respectively the first and second roller, the first and second shafts being rotated respectively in a first shaft circular motion and a second shaft circular motion, the first and second shafts operable to move the first and second rollers in the first and second eccentric circular motions having the first and second circumference, respectfully;

wherein the first and second rollers are peristaltically engaged, respectively, at the first and second circumferences with the flexible tube placed upon the at least one circular section of the inner surface, and the second roller is engaged to the second shaft with a free run that is equal to or above 180 degrees.

* * * * *